US006695604B1

(12) United States Patent
Yu

(10) Patent No.: US 6,695,604 B1
(45) Date of Patent: Feb. 24, 2004

(54) AUTOMOTIVE FUEL PUMP GEAR ASSEMBLY HAVING LIFTING AND LUBRICATING FEATURES

(75) Inventor: DeQuan Yu, Ann Arbor, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/256,359

(22) Filed: Sep. 27, 2002

(51) Int. Cl.[7] ..... F04C 2/10
(52) U.S. Cl. ..... 418/171; 418/77
(58) Field of Search ..... 418/77, 79, 166, 418/171

(56) References Cited

U.S. PATENT DOCUMENTS

| | | | | |
|---|---|---|---|---|
| 3,233,524 A | 2/1966 | Charlson | 418/61.3 |
| 3,547,565 A | 12/1970 | Eddy | 418/61.3 |
| 4,145,167 A | 3/1979 | Baatrup | 418/61.3 |
| 4,384,831 A | 5/1983 | Ikegawa et al. | 418/57 |
| 4,905,535 A | 3/1990 | Ludwig et al. | 418/77 |
| 5,145,347 A | 9/1992 | Freeman | 418/171 |
| 5,997,262 A | 12/1999 | Finkbeiner et al. | 418/171 |

FOREIGN PATENT DOCUMENTS

| | | | |
|---|---|---|---|
| JP | 402149779 A | 6/1990 | |
| JP | 402215985 A | 8/1990 | |
| JP | 403202686 A | 9/1991 | |
| JP | 5-164060 * | 6/1993 | 418/77 |
| JP | 406117379 A | 4/1994 | |

* cited by examiner

*Primary Examiner*—John J. Vrablik
(74) *Attorney, Agent, or Firm*—Brinks Hofer Gilson & Lione

(57) ABSTRACT

The present invention involves a gear assembly having a lifting feature for a fuel pump for supplying fuel to an automotive engine from a fuel tank. The gear assembly comprises an inner gear and an outer gear in mating relationship with the inner gear. The inner gear has a substantially disc shape with an outside camming surface and having an inner cover face and an inner body face. The inner gear has a center aperture formed therethrough defining an axis of rotation perpendicular to the inner cover and inner body faces. The inner cover face has a plurality of inner concave grooves radially formed thereon and spaced apart from each other to provide lifting of the inner gear when rotating about the axis. The outer gear has a substantially planar shape. The outer gear includes an annular wall having an inside camming surface slideably engaging about the outside camming surface to matingly cooperate with the inner gear for rotation about the axis. The outer gear has an outer cover surface and an outer body surface. The outer cover surface has a plurality of outer concave grooves radially formed thereon and spaced apart from each other to provide lifting of the outer gear when rotating about the axis.

19 Claims, 5 Drawing Sheets

AUTOMOTIVE FUEL PUMP GEAR ASSEMBLY HAVING LIFTING AND LUBRICATING FEATURES

BACKGROUND OF THE INVENTION

The present invention generally relates to automotive fuel pumps having a rotary gear assembly.

Gerotor fuel pumps that have a gear assembly with a ring slideably disposed around the outer diameter have been widely used in automotive applications. Such fuel pumps have been used because of their low cost and relatively high efficiency.

However, the efficiency of many of such fuel pumps can still further be improved. For example, a face of a gear assembly of a fuel pump typically contacts the surface of a pump cover of the fuel pump during normal use. Typically, gravity holds the gear assembly down on the surface of the pump cover which, in many situations, creates a friction motion between a surface of the pump cover and the gear assembly. In many situations, this may lead to surface wear in the cover surface and gear cover surface, and creating surface roughness of the cover surface and the surface of the gear assembly. The surface wear of the cover and gear assembly increase the internal leakage of gear assembly, as result, the fuel flow is reduced. Furthermore, surface roughness on the cover surface is accelerated increasing friction between the cover surface and the gear assembly which, in turn, increases pump torque and decreases the speed of the pump motor. As a result, fuel flow from the fuel pump is reduced.

BRIEF SUMMARY OF THE INVENTION

Thus, it is one aspect of the present invention to provide a gerotor fuel pump for supplying fuel to an automotive engine from a fuel tank, wherein the fuel pump includes a gear assembly having lifting and lubricating features to reduce friction and wear between the cover surface and a gerotor surface of the fuel pump.

It is another aspect of the present invention to provide a gerotor or gear assembly having a lifting feature for a fuel pump for supplying fuel to an automotive engine from a fuel tank. In one embodiment, the gear assembly includes an inner gear and an outer gear in mating relationship with the inner gear. The inner gear has a substantially disc shape with an outside camming surface formed about the circumference of the inner gear. The inner gear further has an inner cover face and an inner body face. The inner gear further has a center aperture formed therethrough defining an axis of rotation which is perpendicular to the inner cover and inner body faces. The inner cover face has a plurality of inner concave grooves radially formed thereon and spaced apart from each other to provide lifting of the inner gear when rotating about the axis.

In this embodiment, the outer gear has a substantially planar and has a ring shape. The outer gear includes an annular wall having an inside camming surface slideably engaging about the outside camming surface to matingly cooperate with the inner gear for rotation about the axis. The outer gear has an outer cover surface and an outer body surface. The outer cover surface has a plurality of outer concave grooves radially formed thereon and spaced apart from each other to provide lifting of the outer gear when rotating about the axis.

The following description of the preferred embodiment of the present invention is not intended to limit the scope of the invention to this preferred embodiment, but rather enable any person skilled in the art to make and use the invention.

DETAILED DESCRIPTION OF THE INVENTION

Figure 1:
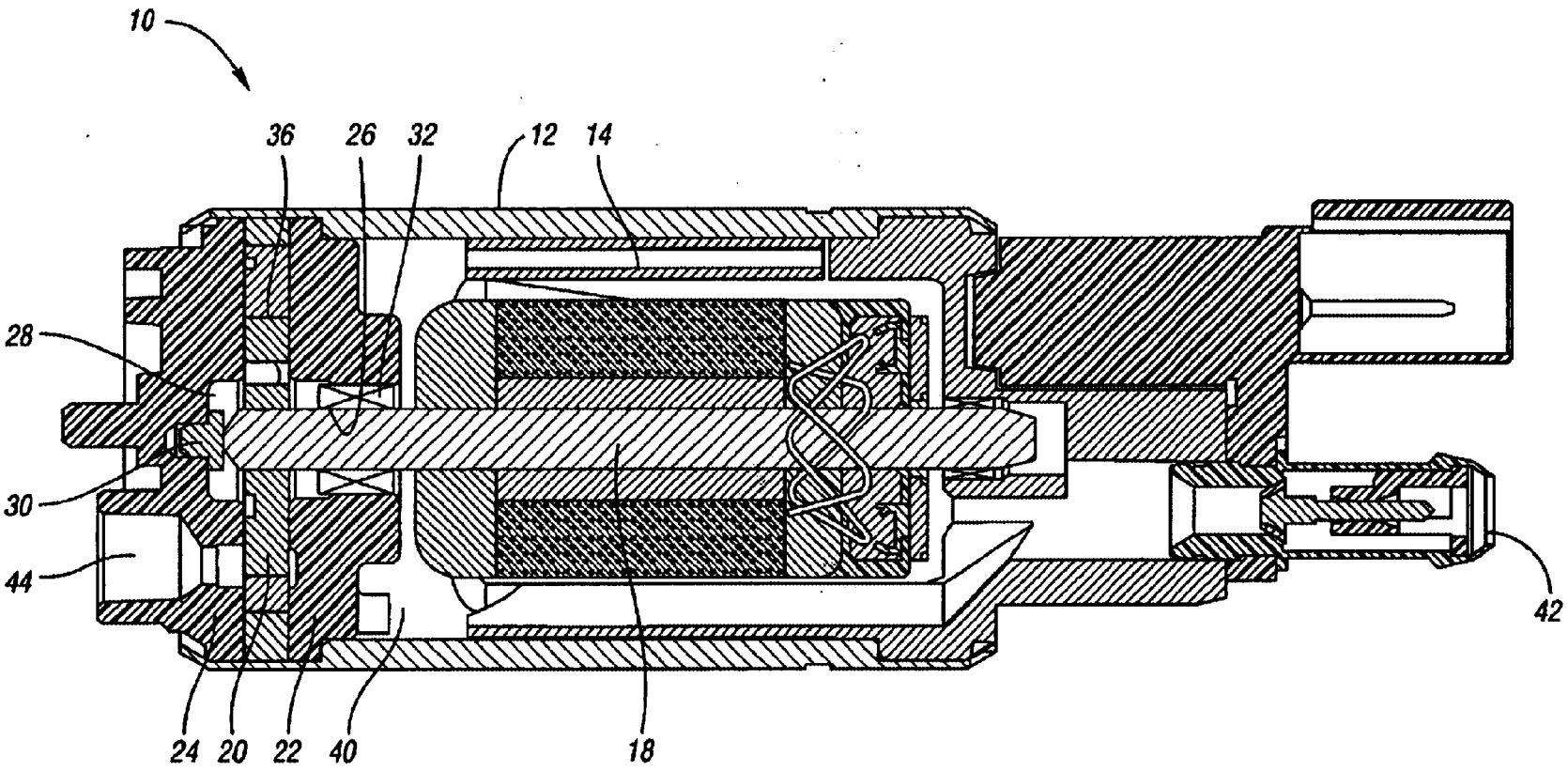
FIG. 1 is a cross sectional view of a fuel pump having a gear assembly in accordance with one embodiment of the present invention.

Referring to FIG. 1, a fuel pump of the present invention is generally shown at 10. The fuel pump 10 includes a housing 12 and a motor 14 mounted within the housing 12. Preferably, the motor 14 is an electric motor with a shaft 18 extending therefrom. A gerotor or gear assembly 20 having inner and outer gears is fitted onto the shaft 18 and is encased within the pump housing 12 between a pump body 22 and a pump cover 24. The gerotor assembly 20 fits onto the shaft 18 such that the assembly is free to move axially along the shaft 18 and rotates with the shaft 18. Therefore, the gerotor assembly "float" between the pump cover 24 and the pump body 22. The fuel pump is of a conventional type which is further described in U.S. Pat. No. 6,113,360 which is assigned to the same assignee as the present application and is hereby incorporated by reference into the present application.

The gerotor assembly 20 has a central axis which is coincident with the axis of the shaft 18. The shaft 18 passes through a shaft opening 26 in the pump body 22, through the gear assembly 20, into a cover recess 28, and abuts a thrust button 30. The shaft 18 is journalled within a bearing 32.

The pump body 22 has a fuel outlet (not shown) leading from the outlet porting 82. Pressurized fuel is discharged through the fuel outlet and cools the motor 14 while passing over the motor 14 to a pump outlet 42 at an end of the pump 10 which is axially opposite a fuel inlet 44.

Figure 2A:
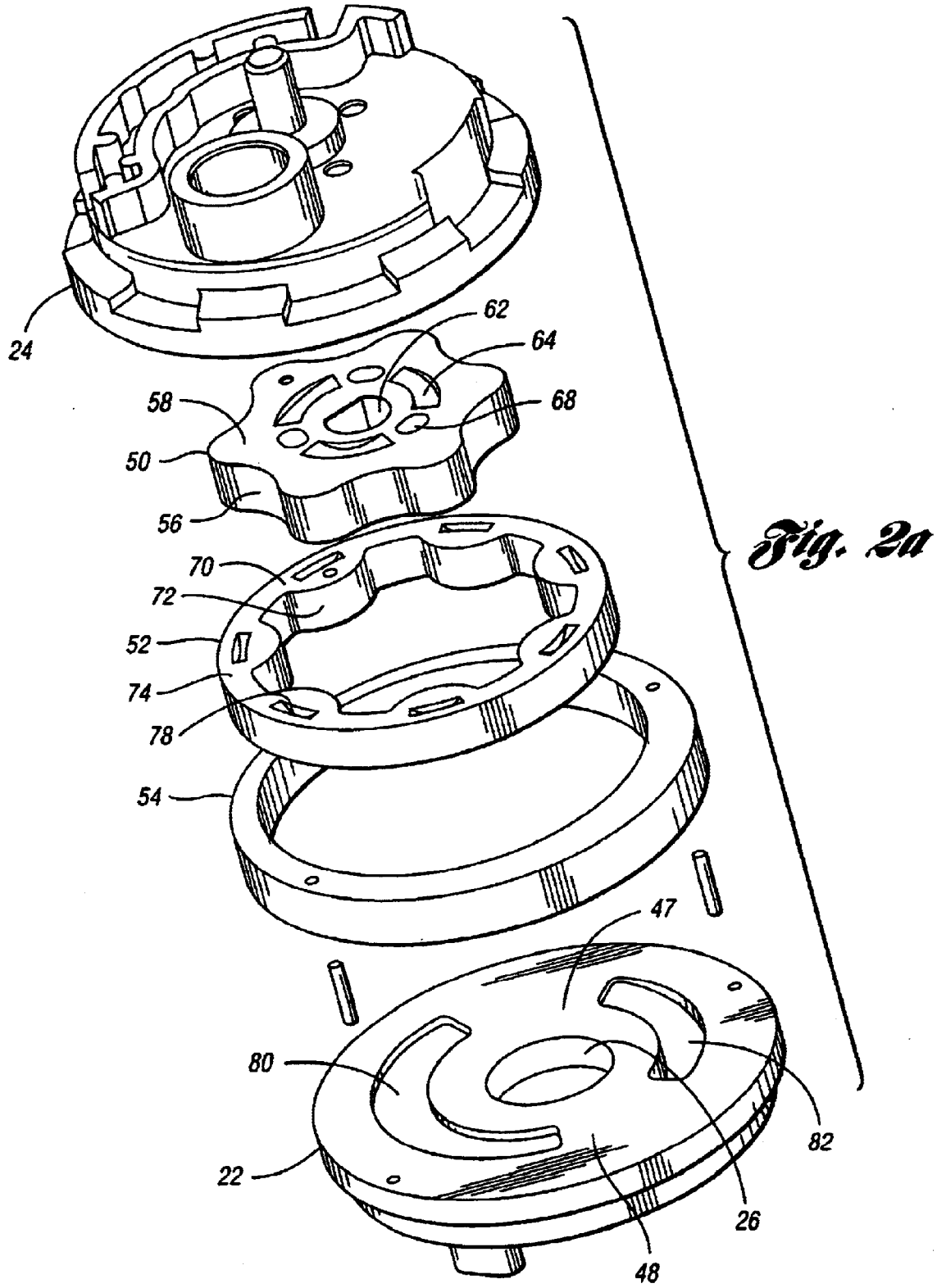
FIG. 2*a* is an exploded inlet view of the gear assembly in FIG. 1.
Figure 2B:
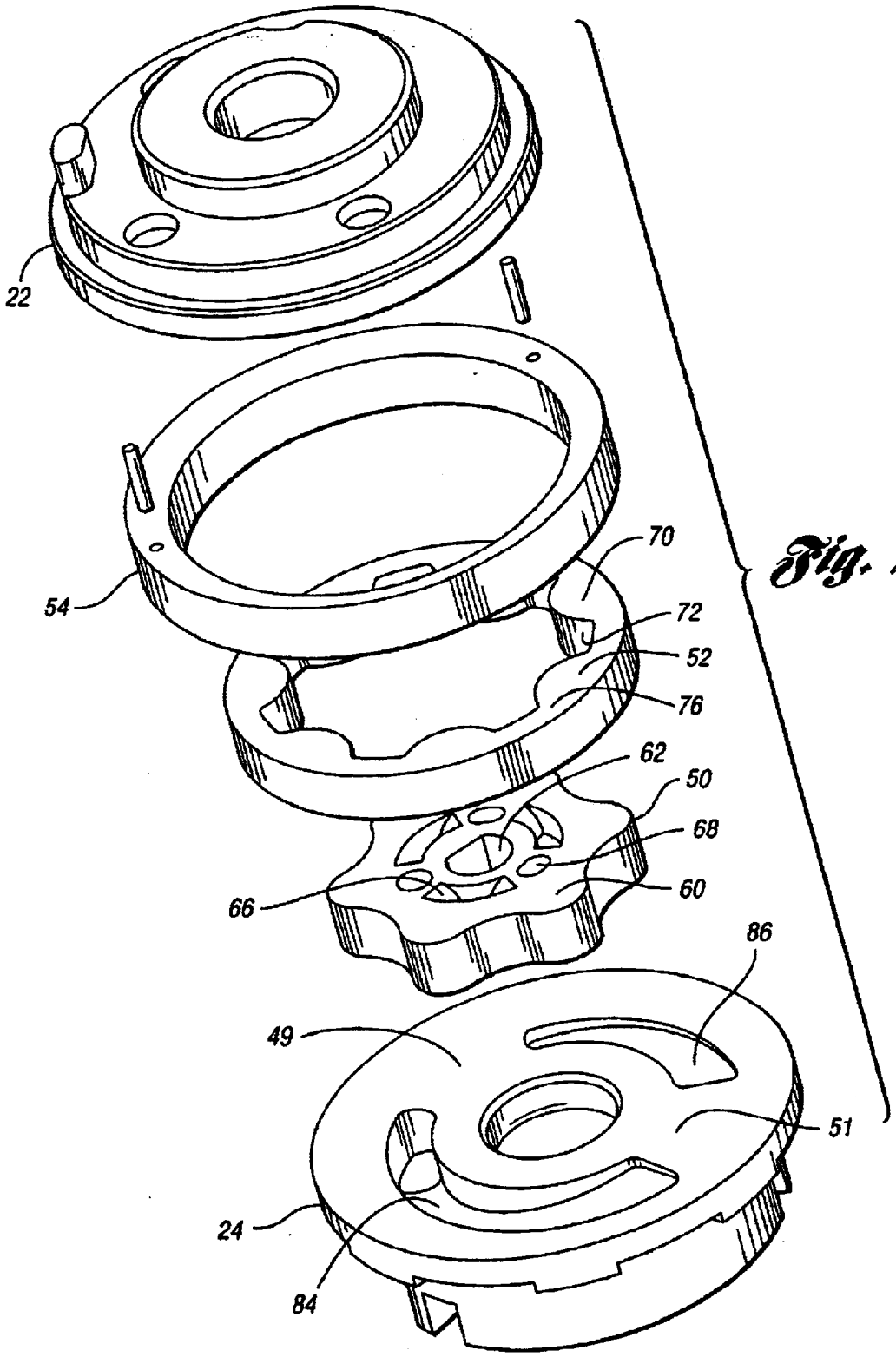
FIG. 2*b* is an exploded exit view of the gear assembly in FIG. 1.

FIGS. 2*a* and 2*b* illustrate an exploded view of the gear assembly 20. As shown, the pump body 22 includes a secondary inlet porting 80, seal areas 47 and 48, and a primary outlet porting 82 formed on the pump body surface. The secondary inlet porting 80 is a low pressure fuel side of the pump body 22 and may be defined by the configuration of the gear assembly. The primary outlet porting 82 is a high pressure fuel side of the pump body 22. As shown, each of the seal areas 47, 48 is formed between one of the portings 80, 82.

Moreover, the pump cover 24 includes a primary inlet porting 84, seal areas 49 and 51, and a secondary outlet porting 86. The primary inlet porting 84 is a low pressure fuel side of the pump cover 24 and may be defined by the configuration of the gear assembly. The secondary outlet porting 86 is a high pressure fuel side of the pump cover. As shown, each of the seal areas 49, 51 is formed between one of the portings 84, 86.

As shown in FIGS. 2*a* and 2*b,* the gear assembly has a lifting and lubricating feature for the fuel pump 10 for supplying fuel to an automotive engine from its fuel tank. The gear assembly 10 includes an inner gear 50 and an outer gear 52 which is disposed about the outer diameter of the inner gear 50. The inner gear 50 and the outer gear 52 are in camming relationship to cooperate with each other for supplying fuel to the automotive engine from the fuel tank.

As will be described in greater detail below, the inner and outer gears 50, 52 are both toothed. The inner gear 50 is toothed along its outer diameter and the outer gear 52 is toothed along an inner wall to cooperate with the inner gear 50. The gear assembly further includes a cram ring 54 which is slideably disposed about the outer diameter of the outer gear.

As shown, the inner gear has a substantially disc shape with an outside camming surface 56 which is a first toothed surface. The inner gear further includes an inner cover face 58 and an inner body face 60. The inner gear 50 further has a center aperture 62 formed therethrough to define an axis A of rotation which is perpendicular to the inner cover face 58 and the inner body face 60.

The inner cover face 58 has a plurality of inner concave grooves 64 radially formed thereon and spaced apart from each other to provide lifting or floating of the inner gear 50 when rotating about axis A. In this embodiment, the plurality of inner concave grooves 64 are radially aligned with each other on the inner cover face 58 of the inner gear 50. Each of the inner concave grooves 64 is radially formed on the inner cover face 58 and extends, for example about 30°–120° and preferably about 90°, thereabout based on the number of inner concave grooves. In this embodiment, each of the inner concave grooves 64 is separated by a flat or planar surface in each end, for example about 5°–20° and preferably about 10°, thereabout on the inner cover face 58 of the inner gear 50 depending on the number of inner concave grooves.

Figure 3A:
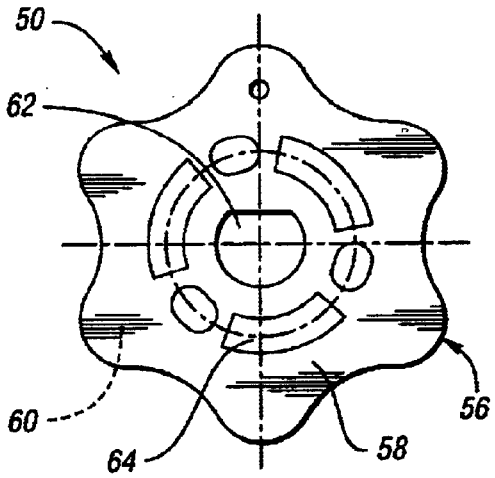
FIG. 3*a* is a first view of an inner gear (cover side) of the gear assembly in accordance with one embodiment of the present invention.
Figure 3B:
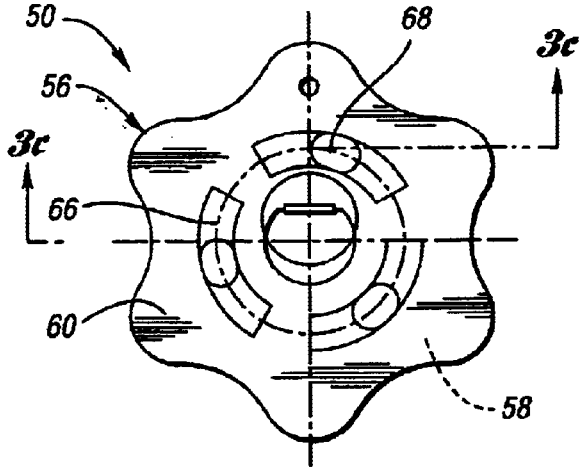
FIG. 3*b* is a second view of the inner gear (body side) in accordance with the present invention.
Figure 3C:
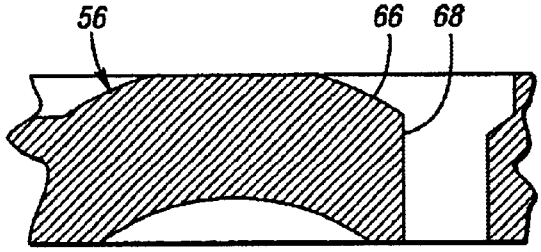
FIG. 3*c* is a cross sectional view of the inner gear taken along lines 3*c*—3*c* in FIG. 3*b;*

As shown, the inner body face 60 has a plurality of inner convex grooves 66 radially formed thereon and spaced apart from each other. Each of the inner convex grooves 66 is opposite with a respective inner concave groove 64 of the inner cover face 58. In this embodiment, each of the inner convex grooves 66 is formed on the inner body face 60 of the inner gear 50 and radially extends, for example about 30°–120 and preferably about 90°, thereabout depending of the number of inner convex grooves. Each of the inner convex grooves 66 are convexly formed, for example about 5°–60° and preferably about 30° on the each end with about 30° flat on the middle (see FIG. 3*c*), on the inner body face 60 of the inner gear 50 based on the number of inner convex grooves.

In this embodiment, the inner gear includes three inner concave grooves and three inner convex grooves. However, it is to be understood that the plurality of inner concave grooves and the plurality of inner convex grooves may include any number of grooves greater than one groove formed on the inner gear without falling beyond the scope or spirit of the present invention.

As shown, the inner gear 50 further includes a plurality of exit holes 68 formed therethrough and spaced apart between each of the inner concave grooves 64. In this embodiment, each of the exit holes 68 is formed through one of the inner convex grooves 66 and extends, for example about 30°, thereabout.

Figure 4A:
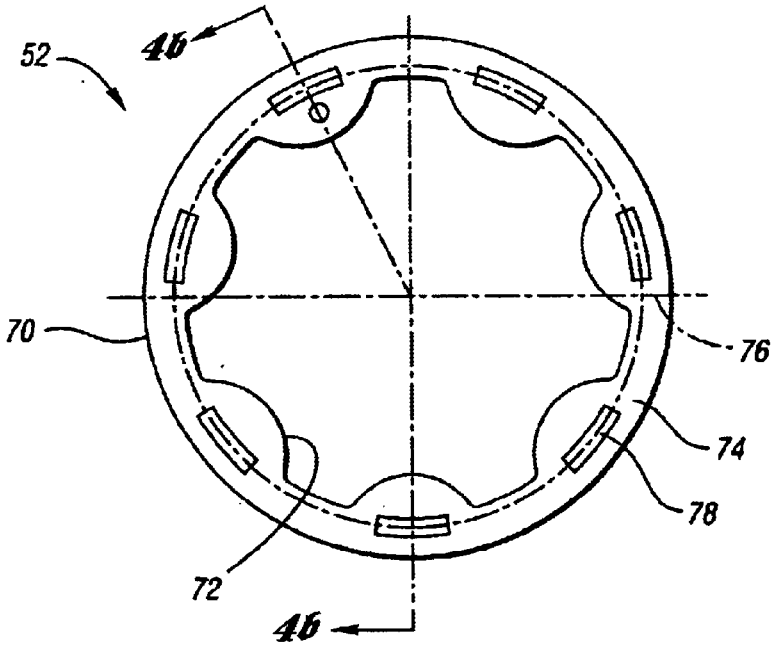
FIG. 4*a* is a first view of an outer gear (cover side) of the gear assembly in accordance with one embodiment of the present invention.
Figure 4B:
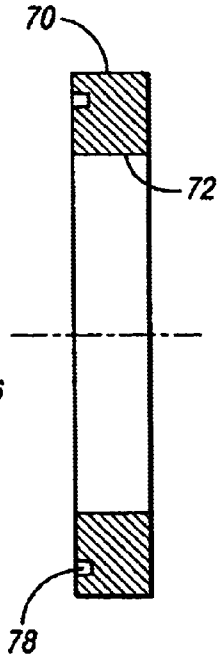
FIG. 4*b* is a cross sectional view of the outer gear taken along lines 4*b*—4*b* in FIG. 4*a;*
Figure 5B:
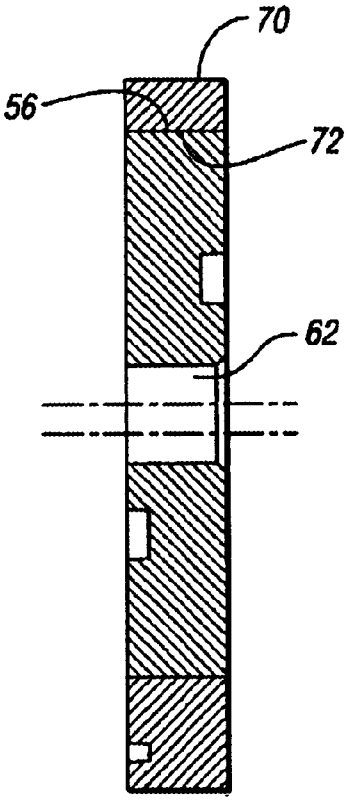
FIG. 5*b* is a cross sectional view of the gear assembly taken along lines 5*b*—5*b* in FIG. 5*a*.
Figure 5A:
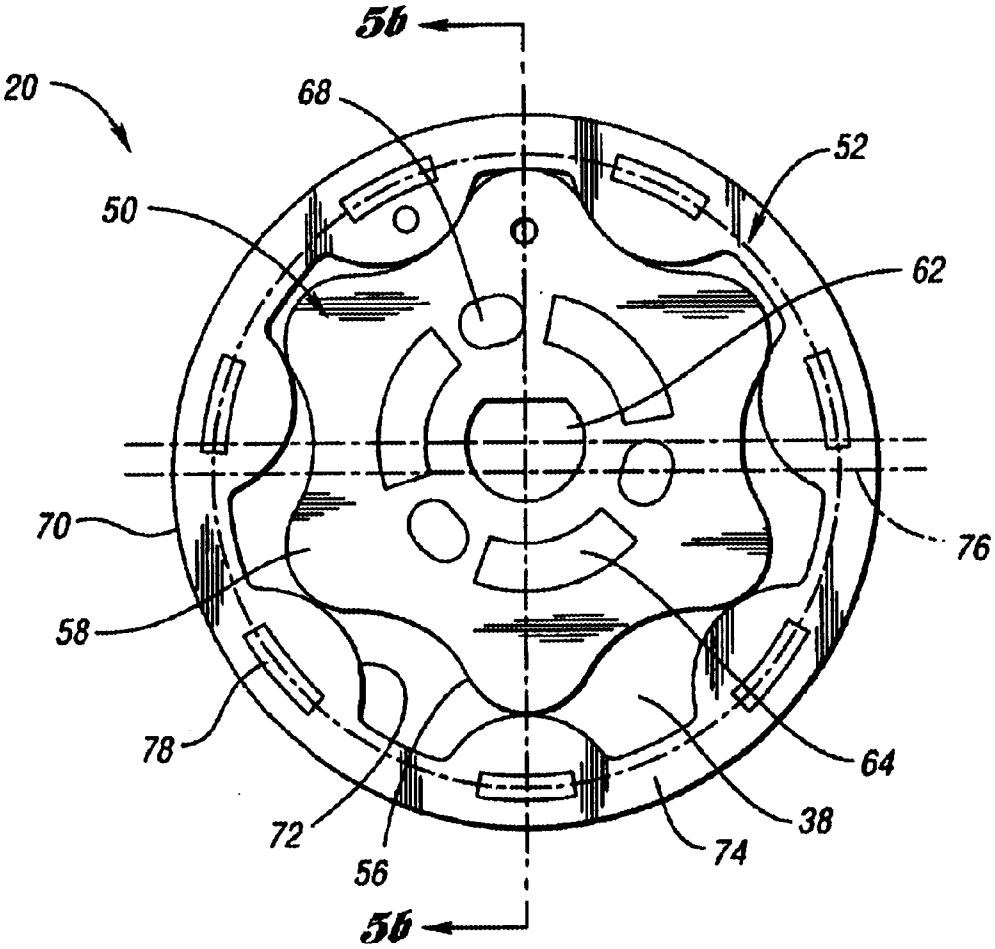
FIG. 5*a* is a cover side view of the gear assembly in accordance with the present invention.

As shown in FIGS. 2, 4, and 5, the outer gear 52 has a substantially planar shape. The outer gear 52 includes an annular wall 70 having an inside camming surface 72. Inside camming surface 72 cammingly engages about the outside camming surface 56 of the inner gear 50 to matingly cooperate with the inner gear 50 for rotation about the axis A. As shown, the inside camming surface 72 is a second toothed surface which matingly cooperates with the first toothed surface of the outside camming surface 56. In this embodiment, the outer gear has one more tooth than the inner gear. As shown, the inner gear and the outer gear are off-center from each other. In this embodiment, during normal use when the gears rotate, the camming surfaces of the gears cooperate such that the cavities 38 changes the volume between the inlet and outlet and that the number of separate cavities are equal to the number of the teeth of the inner gear.

The outer gear 52 has an outer cover surface 74 and an outer body surface 76. In this embodiment, the outer cover surface 74 has a plurality of outer concave grooves 78 radially formed thereon and spaced apart from each other to provide improved lifting or floating of the outer gear 52 when rotating about the axis A. In this embodiment, each of the outer concave grooves 78 extends about 17° about the outer cover surface 74. As shown, each of the outer concave grooves 78 is concavely formed on the outer cover surface 74 of the outer gear 52 and extends about 17° thereabout. In this embodiment, the plurality of the outer concave grooves are radially aligned with each other on the outer cover surface of the outer gear.

Thus, the outside camming surface 56 has teeth formed radially thereon and the inside camming surface 72 has teeth formed radially thereon. The teeth of the inner gear 50 is configured to matingly cooperate with the teeth of the outer gear 52 for rotation of the axis A. As shown, the teeth of the outer gear 52 is greater in number than the teeth of the inner gear 50. For example in this embodiment, the inner gear has six teeth while the outer gear has seven teeth. This allows rotation of the outer gear 52 about the inner gear 50 during normal operation of the fuel pump. As shown, the cram ring 54 is slidably disposed about the outer gear 52.

As shown in FIGS. 2 and 5, pumping cavities 38 are formed between inside camming surface 72 of outer gear 52 and outside camming surface 56 of the inner gear 50. In operation, when the gear assembly rotates, the primary inlet porting 84 of the pump cover and the secondary inlet porting 80 of the pump body feed fuel to the cavities at which volumes increase. Moreover, the primary outlet porting 82 of the pump body and the secondary outlet porting 86 of the pump cover receive fuel from the cavities, at which volumes are decreases, and deliver fuel to the outlet.

In use, the grooves mentioned above of the gear assembly allow the inner and outer gears of the assembly to be lifted and lubricated during rotation about the axis of rotation. As a result, it has been found that the present invention reduces the gear rubbing in the cover surface in turn, reduces surface roughness on the pump cover surface and the pumping chamber internal leakage. This reduces friction and decreases pump torque and internal leakage to increase the speed of the pump rotor. As a result, fuel flow from the fuel pump is maintained.

The gerotor assembly is preferably made of powered metal, or sintered metal, for example, sintered Nickel steel. It is to be understood that the gerotor assembly could also be made from other non-plastic materials known to those skilled in the art such as aluminum or steel. The fuel pump can be mounted within a fuel tank (not shown) or, alternatively, can be mounted in-line between the fuel tank and the engine of the vehicle.

The foregoing discussion discloses and describes two preferred embodiments of the invention. One skilled in the art will readily recognize from such discussion, and from the accompanying drawings and claims, that changes and modifications can be made to the invention without departing from the scope of the invention as defined in the following claims. The invention has been described in an illustrative manner, and it is to be understood that the terminology which has been used is intended to be in the nature of words of description rather than of limitation.

I claim:

1. A gear assembly having a lifting feature for a fuel pump for supplying fuel to an automotive engine from a fuel tank, the assembly comprising:

an inner gear having a substantially disc shape with an outside camming surface and having an inner cover face and an inner body face, the inner gear having a center aperture formed therethrough defining an axis of rotation perpendicular to the inner cover and inner body faces, the inner cover face having a plurality of inner concave grooves radially formed thereon and spaced apart from each other to provide lifting of the inner gear when rotating about the axis, the inner gear including a plurality of exit holes formed therethrough and spaced apart between each of the inner concave grooves, each of the exit holes being formed through the inner gear extending about 30°; and an outer gear having a substantially planar shape, the outer gear including an annular wall having an inside camming surface slideably engaging about the outside camming surface to matingly cooperate with the inner gear for rotation about the axis, the outer gear having an outer cover surface and an outer body surface, the outer cover surface having a plurality of outer concave grooves radially formed thereon and spaced apart from each other to provide lifting of the outer gear when rotating about the axis.

2. The assembly of claim 1 further comprising a cram ring having a peripheral wall slideably disposed about the outer gear allowing rotation about the axis.

3. The assembly of claim 1 wherein each of the inner concave grooves is radially formed on the inner cover face extending about 90°.

4. The assembly of claim 1 wherein the each of the inner concave grooves is separated by a planar surface in each end about 10° on the inner cover face of the inner gear.

5. The assembly of claim 1 wherein each of the outer concave grooves is formed on the outer cover surface extending about 10–30°.

6. The assembly of claim 1 wherein each of the outer concave grooves is concavely formed on the outer gear and extends about 17°.

7. The assembly of claim 1 wherein the inner gear further includes an outside camming surface having teeth formed radially thereon and the outer gear further includes an inside camming surface having teeth formed radially thereon, the teeth of the inner gear being configured to matingly cooperate with the teeth of outer gear for rotation about the axis, the teeth of the outer gear being a greater number than the teeth of the inner gear.

8. The assembly of claim 1 wherein the plurality of inner concave grooves are radially aligned with each other on the inner cover face of the inner gear.

9. The assembly of claim 1 wherein the plurality of outer concave grooves are radially aligned with each other on the outer cover surface of the outer gear.

10. The fuel pump of claim 1 wherein each of the inner concave grooves is radially formed on the inner cover face extending about 90°.

11. A gear assembly having a lifting feature for a fuel pump for supplying fuel to an automotive engine from a fuel tank, the assembly comprising:

an inner gear having a substantially disc shape with an outside camming surface and having an inner cover face and an inner body face, the inner gear having a center aperture formed therethrough defining an axis of rotation perpendicular to the inner cover and inner body faces, the inner cover face having a plurality of inner concave grooves radially formed thereon and spaced apart from each other to provide lifting of the inner gear when rotating about the axis, the inner body face of the inner gear having a plurality of inner convex grooves radially formed thereon, each of the inner convex grooves being formed on the inner body face of the inner gear extending about 90°; and an outer gear having a substantially planar shape, the outer gear including an annular wall having an inside camming surface slideably engaging about the outside camming surface to matingly cooperate with the inner gear for rotation about the axis, the outer gear having an outer cover surface and an outer body surface, the outer cover surface having a plurality of outer concave grooves radially formed thereon and spaced apart from each other to provide lifting of the outer gear when rotating about the axis.

12. A gerotor fuel pump for supplying fuel to an automotive engine from a fuel tank, the fuel pump comprising:

a pump housing;

a motor mounted within the housing and having a shaft extending therefrom;

a pump body mounted within the housing having a bore through which the shaft extends and an outlet channel portion of an annular pumping chamber with a fuel outlet at an end thereof;

a gear assembly including an inner gear and an outer gear, the inner gear having a substantially disc shape with an outside camming surface and having an inner cover face and an inner body face, the inner gear having a center aperture formed therethrough defining an axis of rotation perpendicular to the inner cover and inner body faces, the inner cover face having a plurality of inner concave grooves radially formed thereon and spaced apart from each other to provide lifting of the inner gear when rotating about the axis, the inner gear including a plurality of exit holes formed therethrough and spaced apart between each of the inner concave grooves, each of the exit holes being formed through the inner gear extending about 30°, the outer gear having a substantially planar shape, the outer gear including an annular wall having an inside camming surface slideably engaging about the outside camming surface to matingly cooperate with the inner gear for rotation about the axis, the outer gear having an outer cover surface and an outer body surface, the outer cover surface having a plurality of outer concave grooves radially formed thereon and spaced apart from each other to provide lifting of the outer gear when rotating about the axis; and a pump cover mounted on an end of the housing and attached to the pump bottom with the gear assembly therebetween and having a cover channel portion of an annular pumping chamber with a pump inlet, the pump cover and pump bottom cooperating to form a complete pumping chamber for the gear assembly.

13. The fuel pump of claim 12 further comprising a cram ring having a peripheral wall slideably disposed about the outer gear allowing rotation about the axis.

14. The fuel pump of claim 12 wherein the each of the inner concave grooves is separated by a flat surface in each end about 10° on the inner cover face of the inner gear.

15. The fuel pump of claim 12 wherein each of the outer concave grooves is formed on the outer cover surface extending about 10–30°.

16. The fuel pump of claim 12 wherein each of the outer concave grooves is concavely formed on the outer gear at about 17°.

17. The fuel pump of claim 12 wherein the plurality of inner concave grooves are radially aligned with each other on the inner cover face of the inner gear.

18. The fuel pump of claim 12 wherein the plurality of outer concave grooves are radially aligned with each other on the outer cover surface of the outer gear.

19. A gerotor fuel pump for supplying fuel to an automotive engine from a fuel tank, the fuel pump comprising:

a pump housing;

a motor mounted within the housing and having a shaft extending therefrom;

a pump body mounted within the housing having a bore through which the shaft extends and an outlet channel portion of an annular pumping chamber with a fuel outlet at an end thereof;

a gear assembly including an inner gear and an outer gear, the inner gear having a substantially disc shape with an outside camming surface and having an inner cover face and an inner body face, the inner gear having a center aperture formed therethrough defining an axis of rotation perpendicular to the inner cover and inner body faces, the inner cover face having a plurality of inner concave grooves radially formed thereon and spaced apart from each other to provide lifting of the inner gear when rotating about the axis, the inner body face of the inner gear having a plurality of inner convex grooves radially formed thereon and spaced apart from each other, each of the inner convex grooves being opposite with a respective inner concave groove of the inner cover face, each of the inner convex grooves being formed on the inner body face of the inner gear extending about 90°, the outer gear having a substantially planar shape, the outer gear including an annular wall having an inside camming surface slideably engaging about the outside camming surface to matingly cooperate with the inner gear for rotation about the axis, the outer gear having an outer cover surface and an outer body surface, the outer cover surface having a plurality of outer concave grooves radially formed thereon and spaced apart from each other to provide lifting of the outer gear when rotating about the axis; and a pump cover mounted on an end of the housing and attached to the pump bottom with the gear assembly therebetween and having a cover channel portion of an annular pumping chamber with a pump inlet, the pump cover and pump bottom cooperating to form a complete pumping chamber for the gear assembly.

* * * * *